US008329259B2

(12) United States Patent
Tani

(10) Patent No.: US 8,329,259 B2
(45) Date of Patent: Dec. 11, 2012

(54) ELECTROSTATIC PAINTING APPARATUS AND ELECTROSTATIC PAINTING METHOD

(75) Inventor: Shinji Tani, Nishikamo-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 357 days.

(21) Appl. No.: 12/666,884

(22) PCT Filed: Jul. 15, 2008

(86) PCT No.: PCT/JP2008/063085

§ 371 (c)(1),
(2), (4) Date: Dec. 28, 2009

(87) PCT Pub. No.: WO2009/016986

PCT Pub. Date: Feb. 5, 2009

(65) Prior Publication Data

US 2011/0020561 A1 Jan. 27, 2011

(30) Foreign Application Priority Data

Jul. 31, 2007 (JP) ..... 2007-198731

(51) Int. Cl.
*B05D 1/04* (2006.01)
*B05B 5/025* (2006.01)

(52) U.S. Cl. ..... 427/483; 427/475; 427/477; 427/485; 118/629; 118/668; 118/679

(58) Field of Classification Search ..... 427/475, 427/477, 483, 485; 118/629, 679, 668
See application file for complete search history.

(56) References Cited

U.S. PATENT DOCUMENTS

2002/0046698 A1 * 4/2002 Congard et al. ..... 118/323
2003/0157261 A1 * 8/2003 Ballu ..... 427/421

FOREIGN PATENT DOCUMENTS

| | | | |
|---|---|---|---|
| JP | 59-142182 | | 9/1984 |
| JP | 63-798 | | 1/1988 |
| JP | 1-155191 | | 10/1989 |
| JP | 59-109268 | | 6/1990 |
| JP | 04-108553 | A | 4/1992 |
| JP | 06-142607 | A | 5/1994 |
| JP | 7-18542 | | 5/1995 |
| JP | 08-164349 | A | 6/1996 |
| JP | 2007-069136 | A | 3/2007 |
| WO | 93/22186 | A1 | 11/1993 |
| WO | 99/21688 | A1 | 5/1999 |
| WO | 2006/035259 | * | 4/2006 |
| WO | WO 2006/035259 | A1 | 4/2006 |

* cited by examiner

*Primary Examiner* — Frederick Parker
(74) *Attorney, Agent, or Firm* — Kenyon & Kenyon LLP

(57) ABSTRACT

An electrostatic painting apparatus for electrostatically painting a door on a vehicle body. The painting apparatus uses a robot arm that opens/closes the door. A high voltage is applied to the robot arm and the amount of any current between an electrode pin on the robot arm and the door is measured to determine the positional relationship between the door and the robot arm.

6 Claims, 10 Drawing Sheets

FIG. 5

| OPERATION / CURRENT VALUE (RANGE) | DURING APPROACHING/LEAVING | DURING OPENING/CLOSING |
|---|---|---|
| "a" or more | ABNORMAL (1) | ABNORMAL (1) |
| "a" to "b" | NORMAL | NORMAL |
| "b" to "c" | NORMAL | ABNORMAL (2) |

ELECTROSTATIC PAINTING APPARATUS AND ELECTROSTATIC PAINTING METHOD

This is a 371 national phase application of PCT/JP2008/063085 filed 15 Jul. 2008, claiming priority to Japanese Patent Application No. 2007-198731 filed 31 Jul. 2007, the contents of which are incorporated herein by reference.

FIELD OF THE INVENTION

The present invention relates to an electrostatic painting apparatus and an electrostatic painting method for performing electrostatic painting or coating an opening/closing object provided in an object to be painted by a painting means while opening and closing the opening/closing object by an opening/closing means.

BACKGROUND OF THE INVENTION

As a technique of this type, heretofore, there have been known painting techniques disclosed in for example Patent Literatures 1 to 4 listed below. In particular, Patent Literature 1 discloses a technique of painting or coating the periphery of a door of a vehicle by use of a robot to which a painting gun, an engaging piece engageable with the door, and a sensor for detecting the position of the door are attached. In this technique, the position of the robot is compensated according to the position of the door detected by the sensor and the engaging piece is engaged with the door. Then, the engaging piece is moved by the robot to open the door, and the robot moves the painting gun to coat the periphery of the door. Herein, after the door is opened, the door position is detected again by the sensor to determine whether the door is in an open state or not. Only when the door is in the open state, painting is carried out.

CITATION LIST

Patent Literature

Patent Literature 1: JP6 (1994)-142607A
Patent Literature 2: JP 2007-69136 A
Patent Literature 3: JP 2 (1990)-25664 B2
Patent Literature 4: JP 7 (1995)-18542 Y2

SUMMARY OF INVENTION

Technical Problem

However, in the painting technique disclosed in Patent Literature 1, the sensor is constituted of a proximity switch, but there is no disclosure about an explosion-proof structure. In a painting environment for vehicles or the like, an electric sensor has to be added with the explosion-proof structure. Accordingly, the sensor is housed in an explosion-proof case. In the case where the sensor disclosed in Patent Literature 1 is added with the explosion-proof structure, the peripheral parts of the sensor are increased in size and further the sensor might erroneously detect the door position. In case the door position is erroneously detected, the engaging piece cannot be correctly engaged with the door and the door cannot be opened. Furthermore, the engaging piece and the painting gun or the robot itself could improperly touch the door.

The present invention has been made in view of the above circumstances and has a purpose to provide an electrostatic painting apparatus and an electrostatic painting method capable of realizing prediction of interference with an opening/closing object without providing a special explosion-proof structure.

Solution to Problem (1) To achieve the above purpose, a first aspect of the invention provides an electrostatic painting apparatus for electrostatically painting an opening/closing object provided in an object to be pained by a painting means while opening and closing the opening/closing object by an opening/closing means, comprising; a high-voltage applying means for applying high voltage to the opening/closing means; a discharge current detecting means for detecting a current value of discharge current flowing between the opening/closing means and the opening/closing object; and a positional relationship determining means for determining a positional relationship between the opening/closing object and the opening/closing means based on the detected current value, the positional relationship determining means being configured to determine that (1) the positional relationship is abnormal when the detected current value exceeds a first current value while the opening/closing means is moving closer to or away from the opening/closing object and (2) the positional relationship is abnormal when the detected current value exceeds the first current value or is between a second current value smaller than the first current value and a third current value smaller than the second current value while the opening/closing means is engaged with the opening/closing object and operated to open and close the opening/closing object.

According to the above configuration of the invention, the opening/closing means applied with high voltage by the high-voltage applying means is moved closer to the opening/closing object and then the discharge current flowing between the opening/closing means and the opening/closing object is detected by the discharge current detecting means. This detected discharge current varies according to differences in positional relationship between the opening/closing means and the opening/closing object. This enables prediction of interference between the opening/closing means and the opening/closing object without adding a special explosion-proof structure.

According to the above configuration of the invention, based on the variation in the detected discharge current, the positional relationship determining means determines the positional relationship between the opening/closing means and the opening/closing object. Therefore, the opening/closing state of the opening/closing object by the opening/closing means can be monitored.

(2) To achieve the above purpose, in the above configuration (1), preferably, the opening/closing means includes an articulated robot having a plurality of arms connected in series and an engaging tool engageable with the opening/closing object, the tool being placed at a distal end portion of a distal-side arm of the arms, the discharge current detecting means includes an electrode pin placed in the distal-side arm so as to be able to come closer to the opening/closing object, and the high voltage is applied to at least the distal-side arm.

According to the above configuration of the invention, in addition to the operations of the above configuration (1), the engaging tool provided at the distal end of the distal-side arm is engaged with the opening/closing object and the articulated robot is freely operated to open or close the opening/closing object. When the distal-side arm is moved, the discharge current flowing between the distal-side arm and the opening/closing object is detected in a concentrated manner by the electrode pin. Therefore, in addition to the advantages of the above configuration (1), the interference between the distal-side arm and the opening/closing object can be predicted correctly.

(3) To achieve the above purpose, in the above configuration (2), preferably, the engaging tool is provided with a position sensor for detecting the position of the opening/closing object.

According to the above configuration of the invention, in the operations of the above configuration (2), the engaging tool is moved toward the opening/closing object and thus the position of the opening/closing object is detected by the position sensor. In addition to the advantages of the above configuration (2), accordingly, the engaging tool can be aligned with the position of the opening/closing object based on detection of the opening/closing object by the position sensor.

(4) To achieve the above purpose, a second aspect of the invention provides an electrostatic painting method for electrostatically painting an opening/closing object provided in an object to be pained by a painting means while opening and closing the opening/closing object by the opening/closing means, comprising; applying high voltage to the opening/closing means by a high-voltage applying means; detecting a current value of discharge current discharged between the opening/closing means and the opening/closing object by a discharge current detecting means; performing electrostatic painting while determining a positional relationship between the opening/closing object and the opening/closing means based on the current value detected by the discharge current detecting means, the positional relationship being determined (1) to be abnormal when the detected current value exceeds a first current value while the opening/closing means is moving closer to or away from the opening/closing object and (2) to be abnormal when the detected current value exceeds the first current value or is between a second current value smaller than the first current value and a third current value smaller than the second current value while the opening/closing means is engaged with the opening/closing object and operated to open and close the opening/closing object.

BRIEF DESCRIPTION OF DRAWINGS

FIG. 5 is a table showing determination logic for determining whether a door opening/closing state is normal or abnormal;

REFERENCE SIGNS LIST

Figure 1:
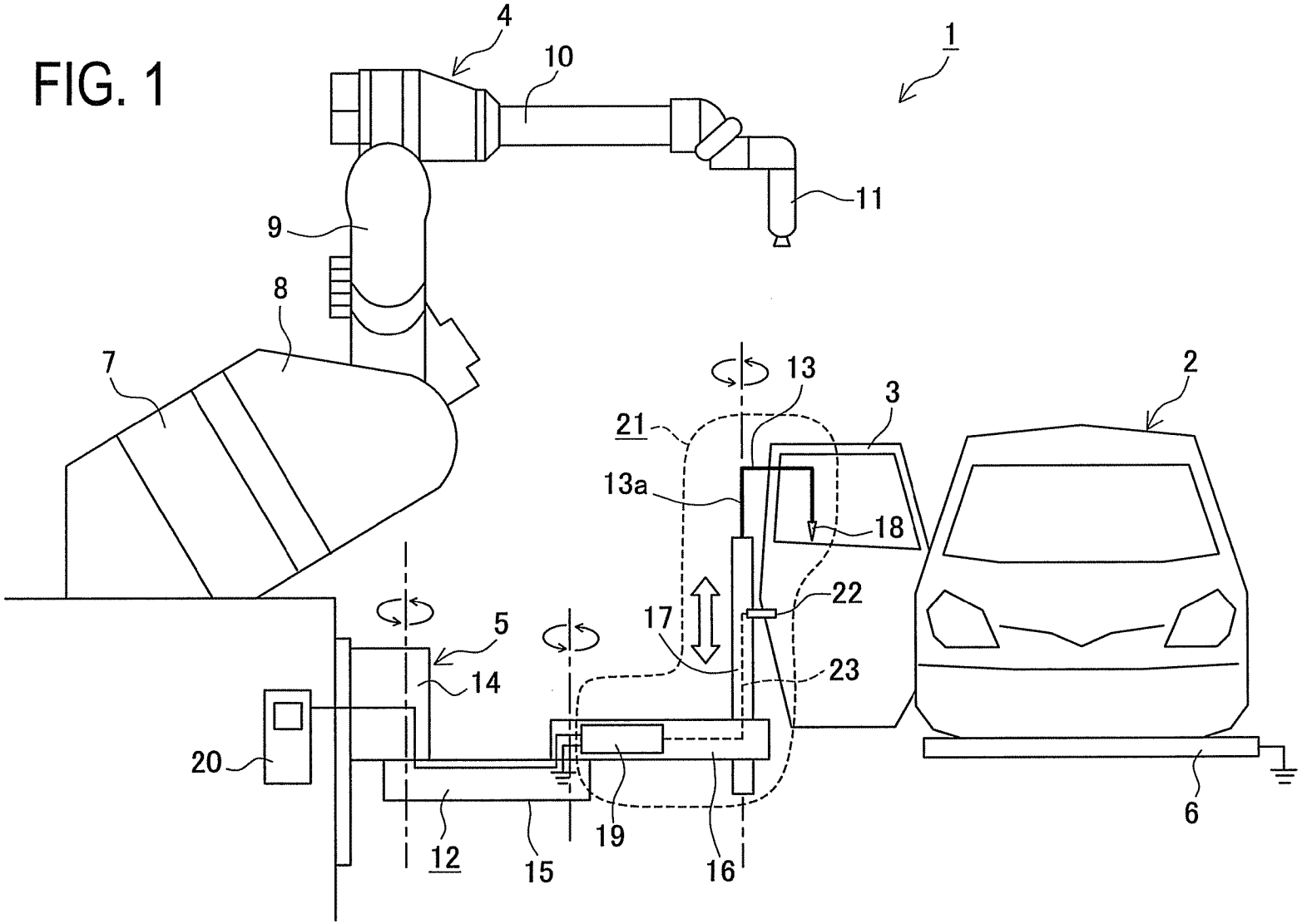
FIG. 1 is a schematic configuration view of an electrostatic painting apparatus.

1 Electrostatic painting apparatus
2 Vehicle body (Object to be painted)
3 Door (Opening/closing object)
4 Door painting robot (Painting means)
5 Door opening/closing apparatus (Opening/closing means)
12 Articulated robot
15 First arm
16 Second arm
17 Third arm
18 Opening/closing hook (Engaging tool)
19 High-voltage generator (High-voltage applying means)
20 High-voltage controller (Positional relation determining means)
22 Electrode pin (Discharge current detecting means)
23 Wiring (Discharge current detecting means)
25 Door opening/closing apparatus (Opening/closing means)
26 Opening/closing hook (Engaging tool)
27 Electrode pin (Discharge current detecting means)
31 Position sensor

DETAILED DESCRIPTION

A detailed description of a preferred embodiment of an electrostatic painting apparatus and an electrostatic painting method embodying the present invention will now be given referring to the accompanying drawings.

FIG. 1 is a schematic configuration view of an electrostatic painting apparatus 1 in this embodiment. This electrostatic painting apparatus 1 is configured to perform electrostatic painting while opening and closing a door 3 which is an opening/closing object provided in a vehicle body 2 as an object to be painted. In this embodiment, the door 3 is a horizontally opening/closing door. This electrostatic painting apparatus 1 includes a door painting robot 4 as an example of a painting means of the invention and a door opening/closing apparatus 5 as an example of an opening/closing means of the invention. The vehicle body 2 is put on a carriage 6 and conveyed to the vicinity of the electrostatic painting apparatus 1. The vehicle body 2 is electrically grounded through the carriage 6.

The door painting robot 4 includes a base member 7, a pivot member 8 pivotally connected to the base member 7, a first arm 9 and a second arm 10 both being pivotally connected in series to the pivot member 8, and a painting nozzle 11 provided at a free end of the second arm 10. The nozzle 11 is configured to eject or spray paint in the form of atomized particles. The above members 7 to 10 are mutually pivoted to allow the nozzle 11 to freely move in all directions; up and down, back and forth, and right and left in a predetermined range.

In this electrostatic painting apparatus 1, the painting nozzle 11 is made negative in polarity and the vehicle body 2 is made positive in polarity, and a high voltage of 30000 to 100000 volts is applied between the nozzle 11 and the vehicle body 2 to perform painting. The atomized particle paint to be ejected through the nozzle 11 is attracted by the vehicle body 2 which is a ground, so that the paint thus elastically adheres to the surface of the vehicle body 2. At that time, the atomized particle paint also flies to the back side of the vehicle body 2 that does not face the nozzle 11 and adheres to the surface of the back side.

The door opening/closing apparatus 5 includes an articulated robot 12 and an opening/closing tool 13 provided at a distal end of the articulated robot 12. The articulated robot 12 includes a base member 14, a first arm 15, a second arm 16, and a third arm 17 which are connected in series to the base member 14. The first arm 15 is supported horizontally to the base member 14 and rotatably in a horizontal direction. The second arm 16 is supported horizontally to the distal end of the first arm 15 and rotatably in a horizontal direction. The third arm 17 on a most distal side is supported vertically to a distal end portion of the second arm 16 so that the arm 17 is rotatable in a horizontal direction and movable in a vertical direction. In this embodiment, the first arm 15 and the third arm 17 are made of metal and the second arm 16 is made of resin.

The opening/closing tool 13 is provided at a distal end of the third arm 17 vertically supported. The opening/closing tool 13 includes a frame 13*a* bent at right angles and an opening/closing hook 18 provided at a distal end of the frame 13*a*. The hook 18 corresponds to an example of an engaging tool of the invention and is provided facing downward to be engageable with the door 3. The hook 18 is made of a conductive material with a resistor, a semi-conducting material, or an insulating material. In this embodiment, the hook 18 is formed of resin which is an insulating material.

Figure 2:
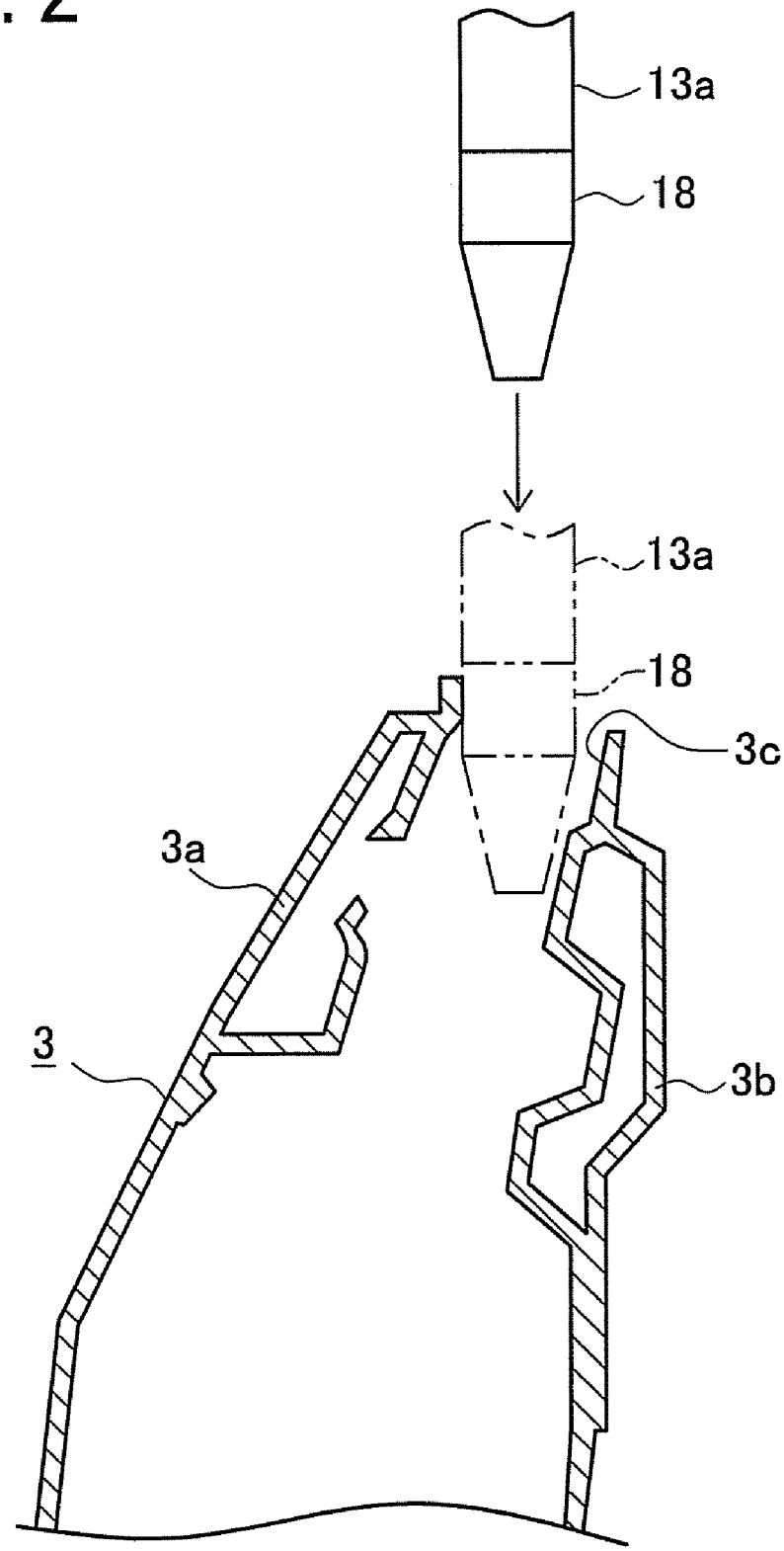
FIG. 2 is a cross sectional view showing an example of a relationship between an opening/closing hook and a door.

FIG. 2 is a cross sectional view showing an example of a relationship between the opening/closing hook 18 and the door 3. The door 3 is constituted of an outer panel 3*a* and an inner panel 3*b*. A glass groove 3*c* is formed between both panels 3*a* and 3*b* to mount therein a window glass. By operating the articulated robot 12 freely, the hook 18 is inserted from a position indicated by a solid line in FIG. 2 into the glass groove 3*c* of the door 3 as shown by a chain double-dashed line in FIG. 2. When the hook 18 in this inserted state is horizontally moved, the door 3 is opened or closed.

Figure 3:
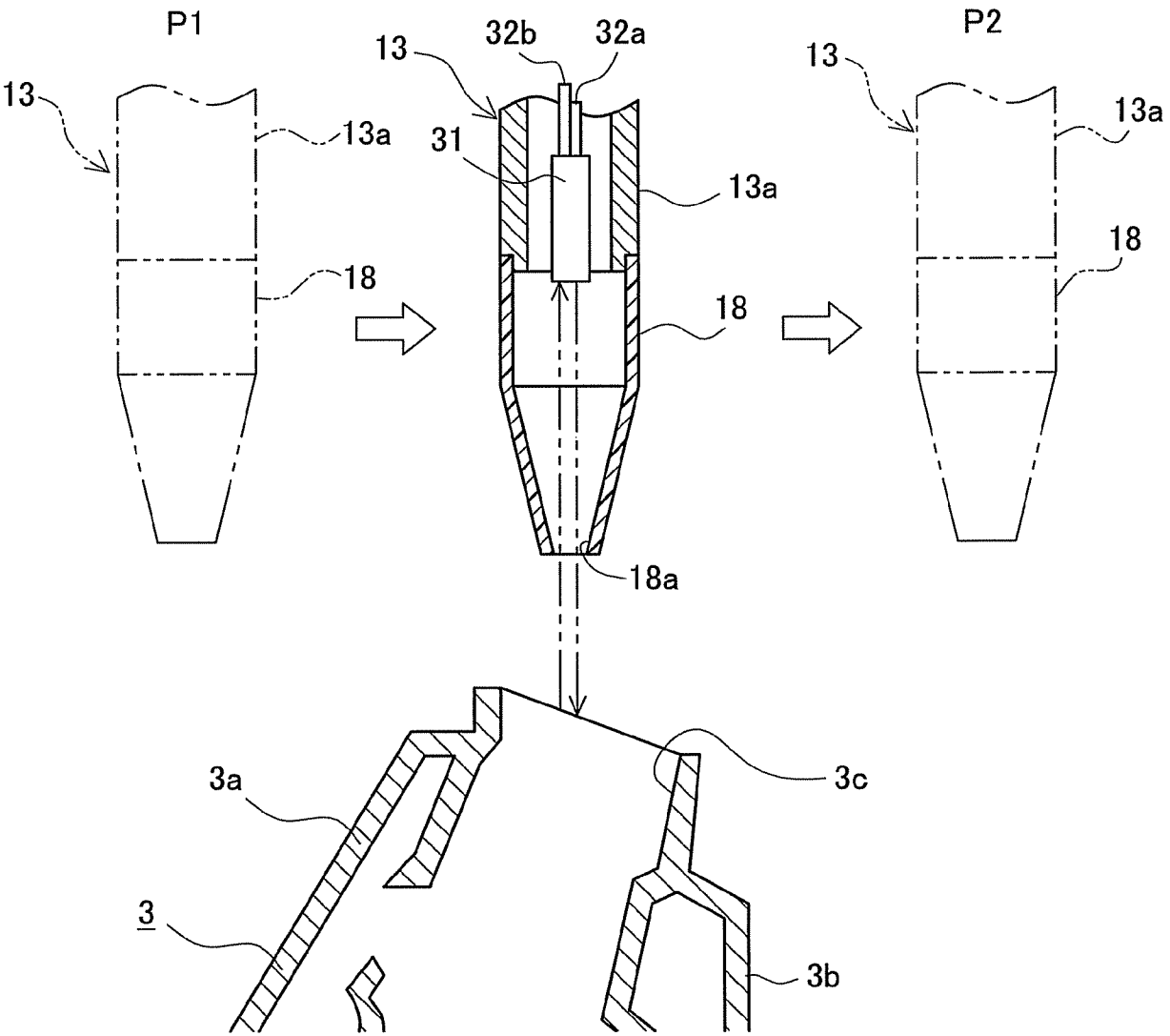
FIG. 3 is a cross sectional view showing a configuration of a distal end portion of an opening/closing tool and others.

FIG. 3 is a cross sectional view of a configuration of the distal end portion of the opening/closing tool 13 and others. The distal end portion of the opening/closing tool 13 including the opening/closing hook 18 is provided with a position sensor 31 for detecting the position of the door 3. The frame 13*a* constituting the opening/closing tool 13 and the hook 18 have a hollow cylindrical shape respectively. The hook 18 is fixedly fitted on the outer periphery of the distal portion end of the frame 13*a*. The hook 18 has a cone-shaped distal end portion tapered toward the tip formed with an opening 18*a*. The position sensor 31 is fixed in the distal end of the frame 13*a* and placed at a boundary between the frame 13*a* and the hook 18. In this embodiment, the position sensor 31 is constituted of an optical fiber sensor needing no explosion-proof measure. This position sensor 31 is connected to optical fibers 32*a* and 32*b* for light projecting and light receiving. Purge air for stain or dust prevention is supplied into the hollow part of the frame 13*a*. The position sensor 31 is configured to project light to and receive light from an object to be detected through the opening 18*a* of the hook 18.

In this embodiment, as shown in FIG. 1, a high-voltage generator 19 is provided as an example of a high-voltage applying means to apply a high voltage having the same polarity as the atomized particle paint for electrostatic painting to the surfaces of the second arm 16, the third arm 17, and the opening/closing tool 13 of the door opening/closing apparatus 5. This high-voltage generator 19 is placed inside of the second arm 16 made of resin. To control this high-voltage generator 19, a high-voltage controller 20 is provided outside the articulated robot 12. In this embodiment, the atomized particle paint has a negative polarity and therefore the second arm 16, the third arm 17, and the opening/closing tool 13 are applied with a high voltage (e.g., "−60 kV") having a negative polarity by the high-voltage generator 19. Accordingly, an electrostatic field 21 (indicated by a broken line in FIG. 1) having the same negative polarity as the atomized particle paint is formed around the second arm 16, the third arm 17, and the opening/closing tool 13.

In this embodiment, an electrode pin 22 is placed to protrude outward from the middle of the third arm 17 located on the most distal side. This electrode pin 22 is connected to the high-voltage generator 19 through a wiring 23. The electrode pin 22 and the wiring 23 constitute an example of a discharge current detecting means of the invention for detecting discharge current between the door opening/closing apparatus 5 and the door 3. The above electrode pin 22 is connected to the high-voltage controller 20 through the wiring 23 and the high-voltage generator 19.

The high-voltage controller 20 is configured to receive the discharge current detected through the electrode pin 22 and others and determine the positional relationship between the door 3 and the third arm 17 based on the discharge current. The high-voltage controller 20 corresponds to an example of a positional relationship determining means of the invention.

In this embodiment, the above electrostatic painting apparatus 1 is used to perform electrostatic painting by the door painting robot 4 while opening and closing the door 3 provided in the vehicle body 2 by the door opening/closing apparatus 5. For this electrostatic painting, the opening/closing hook 18 which comes into contact with the door 3 of the door opening/closing apparatus 5 is made of resin. The electrostatic painting is conducted by causing the high-voltage generator 19 to apply a high voltage having the same negative polarity as the atomized particle paint for electrostatic painting to the surfaces of the second arm 16 and the third arm 17 and the opening/closing tool 13 of the door opening/closing apparatus 5. For this electrostatic painting, furthermore, the high voltage is applied to the second and third arms 16 and 17 of the door opening/closing apparatus 5 by the high-voltage generator 19 and the discharge current to be discharged between the third arm 17 and the door 3 is detected by the electrode pin 22 and others. Thus, the electrostatic painting is performed while the positional relationship between the third arm 17 and the door 3 is determined based on the detected discharge current.

According to the electrostatic painting apparatus 1 in this embodiment explained above, in the door opening/closing apparatus 5, the opening/closing hook 18 which directly contacts with the door 3 is made of resin. Accordingly, the hook 18, while retaining engaged with the door 3, is applied with the high voltage having the same polarity as the atomized particle paint for electrostatic painting. Thus, all the electric current does not flow to the door 3 and a high voltage is applied to the hook 18, so that the electric charge is retained on the surface of the hook 18. Consequently, floating atomized paint particles not having been deposited repel the electric charge of the surface of the hook 18 and are unlikely to adhere to the surface. As a result, it is possible to reduce stains on the hook 18 to be used for opening and closing the door 3 caused by the undeposited paint.

In this embodiment, the opening/closing tool 13 including the opening/closing hook 18 and also the second arm 16 and the third arm 17 constituting the articulated robot 12 are applied with high voltage having the same polarity as the atomized particle paint. The electric charge thereof is also retained on the surfaces of the tool 13 and the second and third arms 16 and 17. Therefore, the floating atomized particle paint not having been deposited repels the electric charge of the surfaces of those members 13, 16, and 17 and is unlikely to adhere to their surfaces. As a result, it is similarly possible to reduce stains on the tool 13 and the second and third arms 16 and 17 caused by the undeposited paint.

In this embodiment, the high-voltage generator 19 is placed in the second arm 16 of the articulated robot 12. Accordingly, a special installation space for the high-voltage generator 19 is not required. The door opening/closing apparatus 5 can therefore be made compact while maintaining a high-voltage application function.

In this embodiment, as explained above, it is possible to reduce stains caused by the undeposited paint on the opening/closing tool 13 and the second and third arms 16 and 17 which are parts comes into contact or closer to the door 3 in the door opening/closing apparatus 5. Thus, cleaning frequency to remove stains from the door opening/closing apparatus 5 can be reduced. For example, the cleaning to remove stains is heretofore conducted once after the electrostatic painting operation for about one hour. On the other hand, according to this embodiment, the cleaning to remove stains has only to be conducted once after the electrostatic painting operation for about four to five hours. Furthermore, the stain paint is prevented from adhering in the form of spits to the vehicle body 2 and the door 3. This makes it possible to prevent deterioration in painting quality of the vehicle body 2 and others.

In this embodiment, while the high-voltage generator 19 applies a high voltage to the door opening/closing apparatus 5, the third arm 17 of the door opening/closing apparatus 5 is moved with respect to the door 3. At that time, the discharge current flowing between the third arm 17 and the door 3 is detected in a concentrated manner by the electrode pin 22. In this embodiment, therefore, the high-voltage controller 20 can correctly predict interference between the third arm 17 and the door 3 based on changes in discharge current detected in a concentrated manner through the electrode pin 22. The opening/closing state of the door 3 by the third arm 17 can be monitored by the high-voltage controller 20. In this embodiment, for monitoring the opening/closing state of the door 3, it is only necessary to detect the discharge current between the third arm 17 and the door 3. Thus, no special explosion-proof structure needs to be added.

Figure 4:
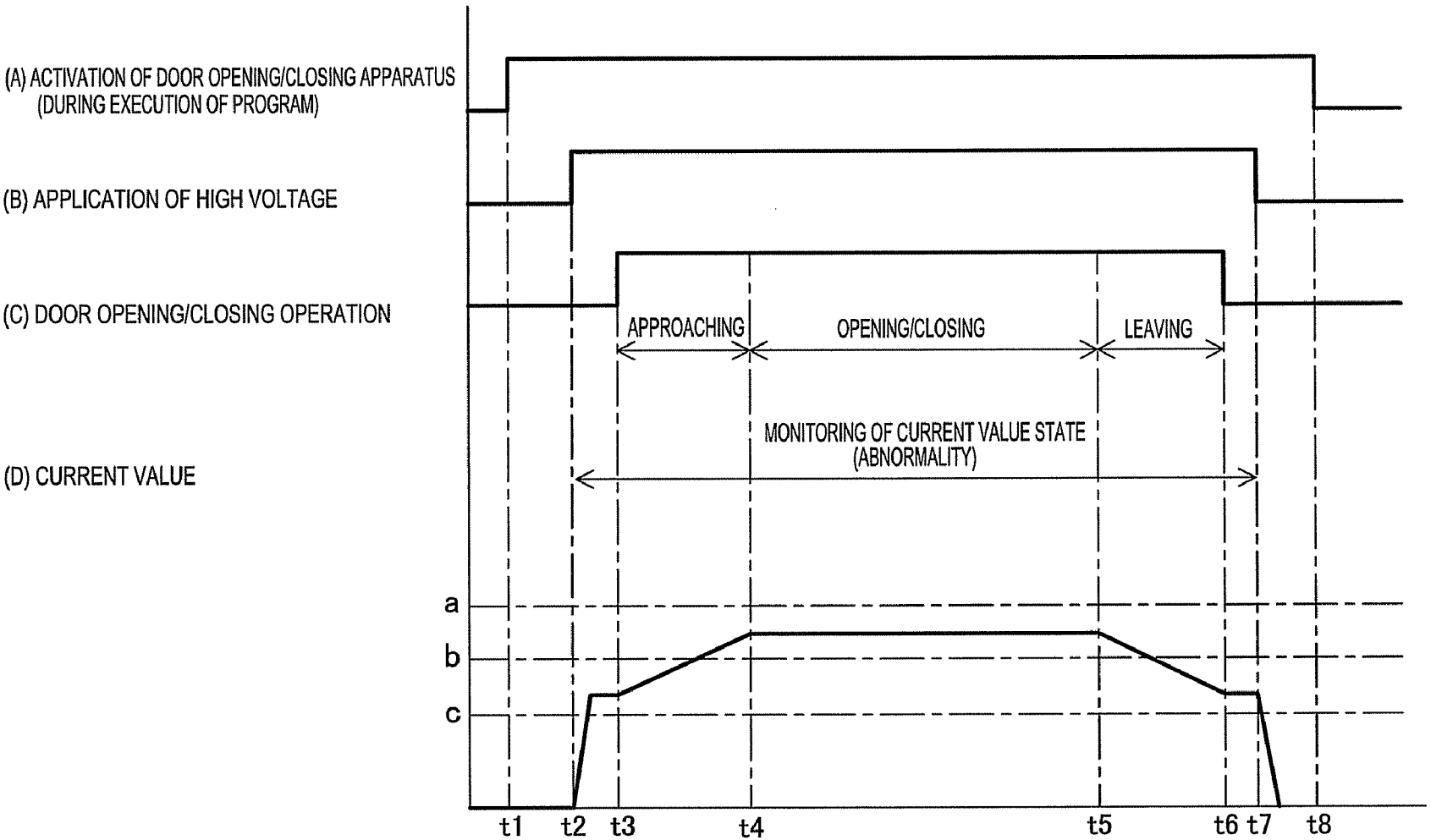
FIG. 4 is a time chart showing a relationship between activation of a door opening/closing apparatus, application of high voltage, opening/closing operations of a door, and current value in a normal state.

FIG. 4 is a time chart showing the case where the opening/closing operation of the door 3 is normally conducted by the door opening/closing apparatus 5 for electrostatic painting in relation to (A) Activation of the door opening/closing apparatus 5, (B) Application of high voltage by the high-voltage generator 19, (C) Door opening/closing operation by the door opening/closing apparatus 5, and (D) Behaviors of a current value of the discharge current detected through the electrode pin 22. In this embodiment, as shown in FIG. 4 (A), the opening/closing state of the door 3 is determined at each time t1 to t8 during operation of the door opening/closing apparatus 5. Herein, as shown in FIGS. 4 (B) and (C), the application of high voltage to the door opening/closing apparatus 5 is started at time t2 slightly before the time when the door 3 is opened (time t3) and then the application of high voltage is stopped at time t7 slightly after the time when the door 3 is closed (time t6). As shown in FIG. 4 (D), a current value of the discharge current detected through the electrode pin 22 rises just after the high voltage is applied at time t2. Between times t3 and t4, the current value increases as the third arm 17 is moved closer to the door 3 to open the door 3. Then, while the door 3 is open between times t4 and t5, the current value remains unchanged. After the door 3 is closed at time 5, the current value decreases as the third arm 17 is moved away from the door 3 between times t5 and t6. Just after the application of high voltage is stopped at time t7, the current value falls down. In the case where the opening/closing operation of the door 3 is normally performed by the door opening/closing apparatus 5 as above, the current value of the discharge current detected through the electrode pin 22 properly changes between values a, b, and c as shown in FIG. 4 (D) in accordance with the opening/closing operation of the door shown in FIG. 4 (C). By monitoring the behaviors of this current value, the interference between the third arm 17 and the door 3 can be predicted, thereby monitoring the opening/closing state of the door 3 caused by the door opening/closing apparatus 5.

FIG. 5 is a table showing determination logic for determining whether the opening/closing state of the door 3 is normal or abnormal. In this embodiment, as shown in the table, in the case of "during approaching and leaving operation", that is, in the case where the third arm 17 and the door 3 move closer to or away from each other, the current value not exceeding the upper limit "a" is determined to be "normal" and the current value exceeding the upper limit "a" is determined to be "abnormal". In this embodiment, on the other hand, in the case of "during opening/closing operation", that is, in the case where the opening/closing hook 18 is engaged with the door 3 to open or close the door 3, the current value being between the upper limit "a" and the middle value "b" is determined to be "normal", the current exceeding the upper limit "a" is determined to be "abnormal (1)", and the current being between the middle value "b" and the lower limit "c" is determined to be "abnormal (2)".

Figure 6:
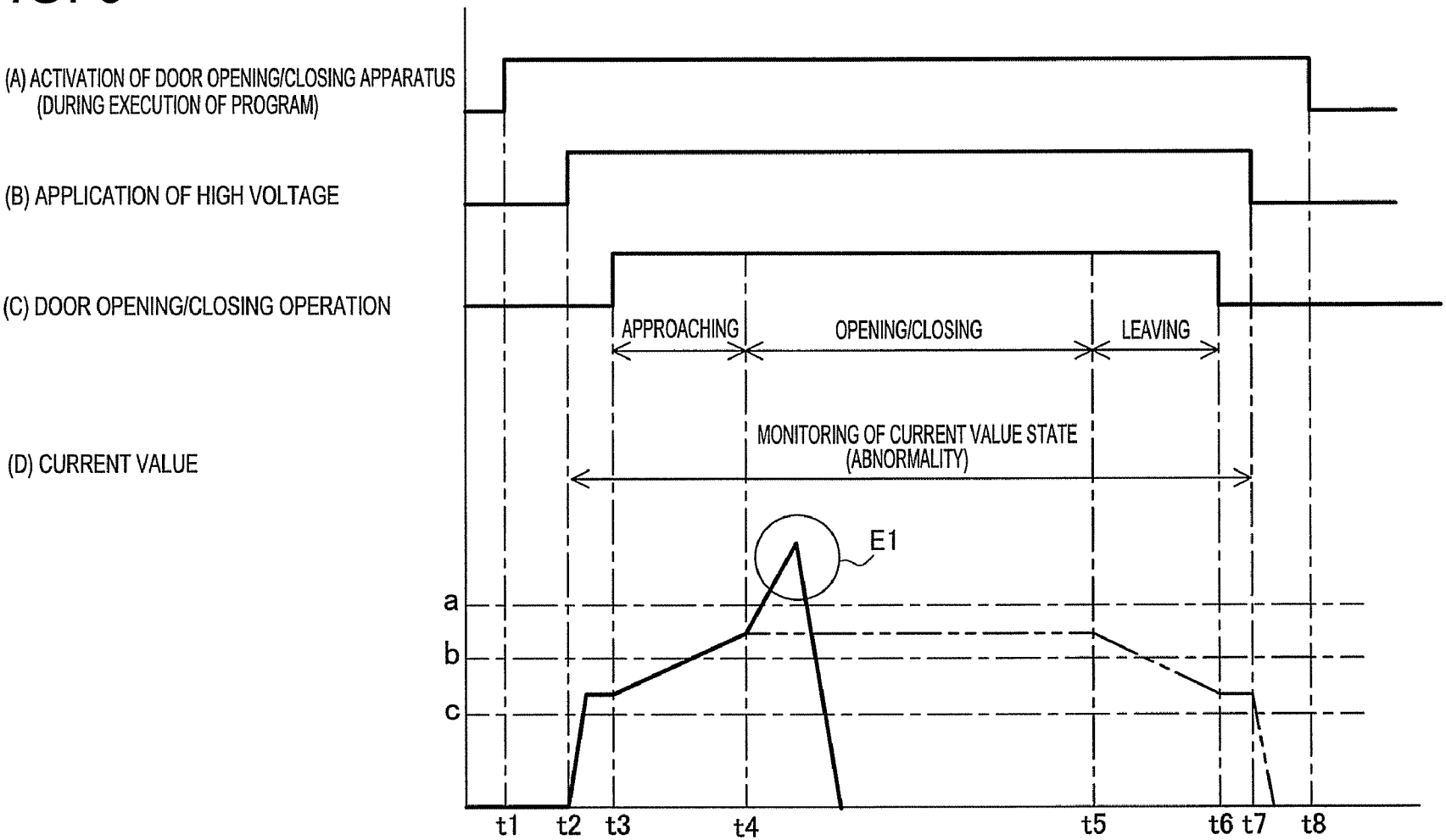
FIG. 6 is a time chart showing a relationship between activation of a door opening/closing apparatus, application of high voltage, opening/closing operations of a door, and current value in an abnormal state.

FIG. 6 is a time chart showing the case where the third arm 17 of the door opening/closing apparatus 5 abnormally moves closer to the door 3 for electrostatic painting in relation to (A) Activation of the door opening/closing apparatus 5, (B) Application of high voltage by the high-voltage generator 19, (C) Door opening/closing operation by the door opening/closing apparatus 5, (D) Behaviors of a current value of the discharge current detected through the electrode pin 22. As shown by a solid line in FIG. 6 (D), while the door 3 is open from time t4 to time t5, if the current value exceeds the upper limit "a" as indicated by a circular solid line E1, the high-voltage controller 20 determines the door opening/closing operation is abnormal. A chain double-dashed line in FIG. 6 (D) indicates changes in current value in the normal case.

Figure 7:
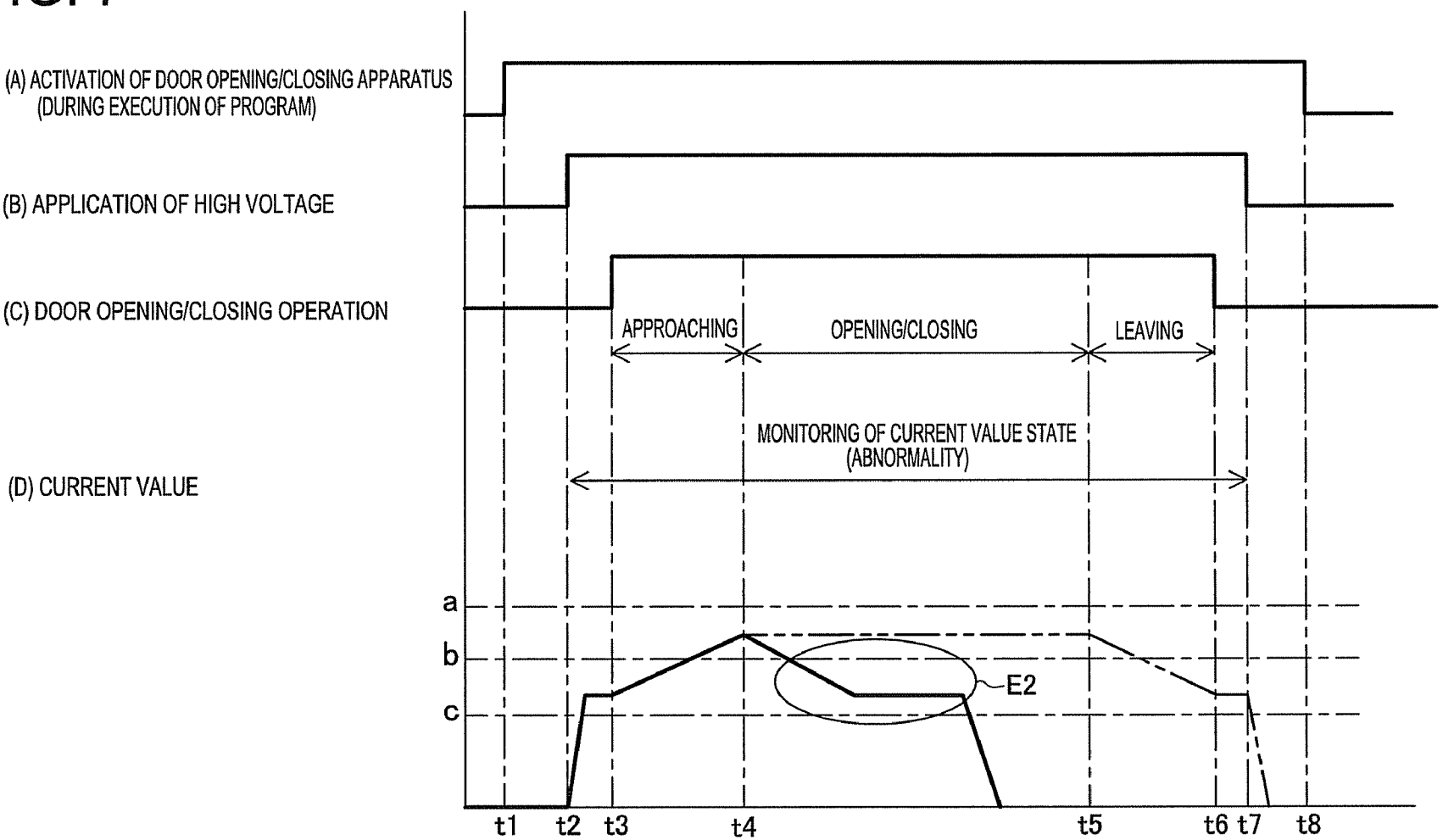
FIG. 7 is a time chart showing a relationship between activation of a door opening/closing apparatus, application of high voltage, opening/closing operations of a door, and current value in an abnormal state.

FIG. 7 is a time chart showing the case where the third arm 17 of the door opening/closing apparatus 5 abnormally moves away from the door 3 for electrostatic painting in relation to (A) Activation of the door opening/closing apparatus 5, (B) Application of high voltage by the high-voltage generator 19, (C) Door opening/closing operation by the door opening/closing apparatus 5, (D) Behaviors of a current value of the discharge current detected through the electrode pin 22. As shown by a solid line in FIG. 6 (D), while the door 3 is open from time t4 to time t5, if the current value is between the middle value "b" and the lower limit "c" as indicated by an elliptic solid line E2, the high-voltage controller 20 determines that door opening/closing operation is abnormal. A chain double-dashed line in FIG. 7 (D) indicates changes in current value in the normal case.

In this embodiment, as explained above, the high-voltage controller 20 monitors the positional relationship between the third arm 17 and the door 3, i.e., the opening/closing state of the door 3 by the door opening/closing apparatus 5 based on the discharge current detected through the electrode pin 22 and determines whether the opening/closing state is normal or abnormal. In the case where the opening/closing state of the door 3 is determined as normal, the door painting robot 4 and the door opening/closing apparatus 5 are operated in accordance with a previously set program to perform electrostatic painting on the door 3 as scheduled. In the case where the opening/closing state of the door 3 is determined as abnormal, the operations of the door painting robot 4 and the door opening/closing apparatus 5 have only to be immediately stopped to interrupt the electrostatic painting. As above, the electrostatic painting can be properly performed with respect to the door 3 while the opening/closing state of the door 3 is monitored.

In this embodiment, the opening/closing hook 18 is provided with the position sensor 31 to detect the position of the door 3. When the hook 18 is moved toward the door 3, accordingly, the position sensor 31 detects the position of the door 3. The hook 18 can be precisely aligned with the position of the door 3 based on detection of the door 3 by the position sensor 31.

Figure 8:
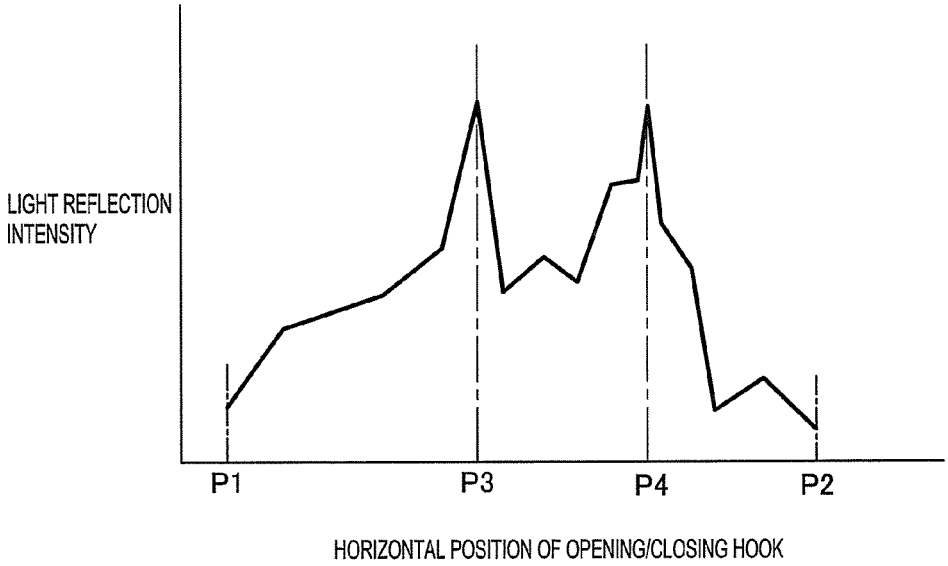
FIG. 8 is a graph showing a relationship between a horizontal position of an opening/closing hook and light reflection intensity detected by a positional sensor.

As indicated by the chain double-dashed line in FIG. 3, the opening/closing hook 18 is horizontally moved along the upper part of the door 3 from a first position P1 on the left side to a second position P2 on the right side. During this movement, the position sensor 31 is activated, thereby detecting the position of the glass groove 3*c* of the door 3. In this regard, a relationship between a horizontal position of the hook 18 and a light reflection intensity detected by the position sensor 31 is shown as a graph in FIG. 8. As seen in FIG. 8, the light reflection intensity changes while exhibiting two peaks at two intermediate positions P3 and P4 between the first position P1 and the second position P2. One peak at the intermediate position P3 represents that the position sensor 31 reaches just above the top of the outer panel 3*a* in FIG. 3 and the other peak at the intermediate position P4 represents that the position sensor 31 reaches just above the top of the inner panel 3*b* in FIG. 3. Thus, when those two intermediate positions P3 and P4 are identified in a movable range of the opening/closing hook 18, a section between the intermediate positions P3 and P4 can be determined as the position of the glass groove 3*c*. Such positional information detected by the position sensor 31 is fed back to the operation of the door opening/closing apparatus 5. The opening/closing hook 18 can therefore be reliably inserted and engaged in the glass groove 3*c* of the door 3.

In this embodiment, the position sensor 31 is placed in the opening/closing hook 18 and thus is protected from dust (stains). Since purge air is supplied into the opening/closing hook 18, the position sensor 31 can be further protected from dust (stains). In this embodiment, furthermore, since the position sensor 31 is an optical fiber sensor requiring no explosion-proof measure, no explosion-proof structure needs to be added. Consequently, the position sensor 31 can be placed in a smaller size in the opening/closing hook 18.

The present invention is not limited to the above embodiment and may be embodied in other specific forms without departing from the essential characteristics thereof.

Figure 9:
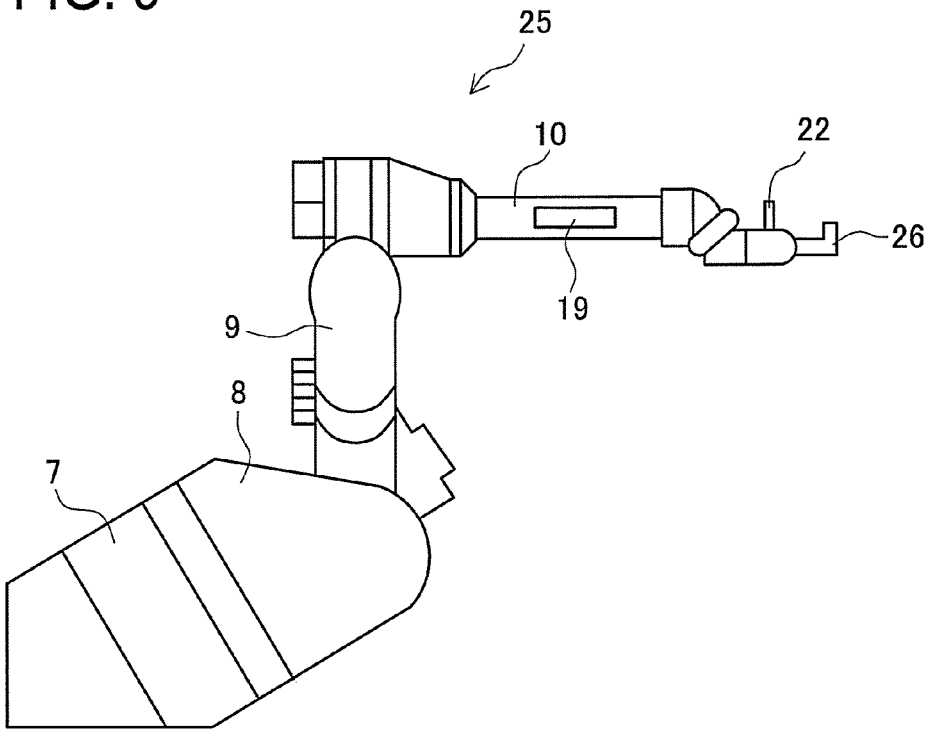
FIG. 9 is a side view of an opening/closing apparatus.

(1) In the above embodiment, the door 3 to be opened/closed horizontally is considered as an opening/closing object. The door opening/closing apparatus 5 for opening and closing the door 3 is configured to detect discharge current through the electrode pin 22 provided in the third arm 17 to determine the opening/closing state of the door 3. Alternatively, the opening/closing object may be a trunk cover or a bonnet (hood) of a vehicle body or a flip-up rear door of a vehicle body, which are opened and closed in a vertical direction. Accordingly, an opening/closing apparatus for opening and closing the trunk cover, bonnet, or flip-up door is configured to detect discharge current through an electrode pin to determine the opening/closing state of the trunk cover or the like. For instance, as shown in FIG. 9, a robot having the same configuration as the aforementioned door painting robot 4 may be used as a door opening/closing apparatus 25 corresponding to an example of an opening/closing means. In FIG. 9, a second arm 10 is made of resin and a high-voltage generator 19 is placed in the second arm 10. At a distal end portion of the second arm 10, an electrode pin 22 and a right-angled opening/closing hook 26 made of resin serving as an engaging tool are provided respectively. This hook 26 is engaged with the trunk cover or the like and the second arm 10 is rotated upward and downward to open and close the trunk cover or the like in the vertical direction. During this opening/closing operation, the discharge current is detected through the electrode pin 22 and thus the opening/closing state of the trunk cover or the like can be determined.

Figure 10:
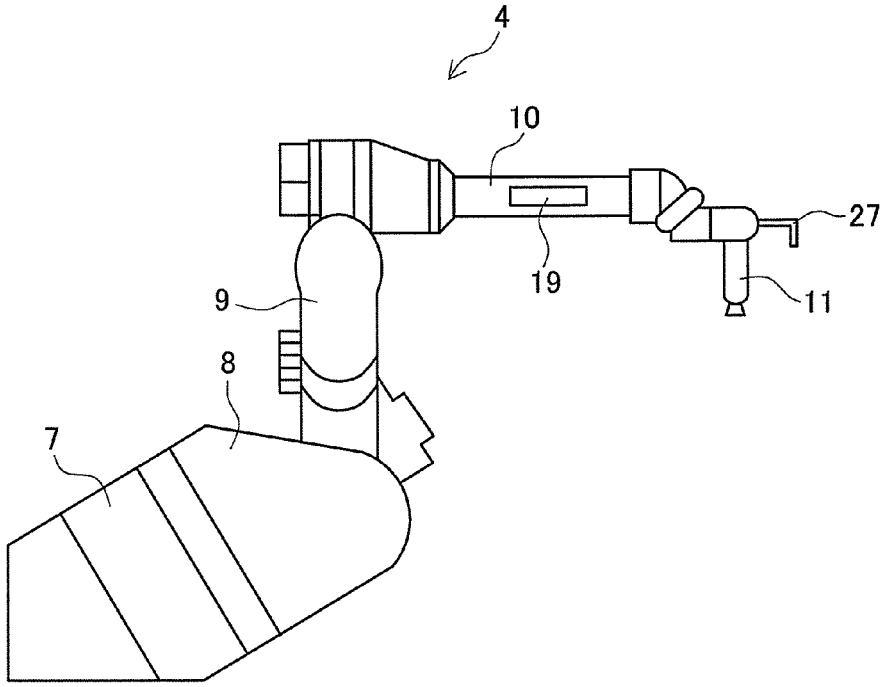
FIG. 10 is a side view of a door painting robot.

(2) In this embodiment, the door 3 is an opening/closing object. The door opening/closing apparatus 5 for opening and closing the door 3 is configured to detect the discharge current through the electrode pin 22 provided in the third arm 17 to determine the opening/closing state of the door 3. In addition, as shown in FIG. 10, the door painting robot 4 may be configured such that the second arm 10 is made of resin and the high-voltage generator 19 is placed in the second arm 10, and a hook-shaped electrode pin 27 corresponding to an example of a discharge current detecting means is provided at a free end of the second arm 10. Thus, the discharge current is detected through the electrode pin 27 to determine the positional relationship between the door 3 and the painting nozzle 11. In this case, the interference between the painting nozzle 11 and the door 3 can be predicted without adding a special explosion-proof structure. It is further possible to monitor the approaching state between the painting nozzle 11 and the door 3. In addition, this configuration may be arranged such that, after the positional relationship between the door 3 and the painting nozzle 11 is determined, the electrode pin 27 is withdrawn into the second arm 10 by use of a cylinder or the like in order to avoid interference between the electrode pin 27 and the door 3 when the painting nozzle 11 is to be freely operated.

(3) In the above embodiment, the opening/closing tool 13 and both the second arm 16 and the third arm 17 are applied with high voltage. An alternative is to apply high voltage only to the opening/closing tool 13 and the third arm 17.

(4) In the above embodiment, the opening/closing hook 18 is made of resin which is an insulating material. This opening/closing hook may be made of a conductive material with a resistor or a semi-conducting material. The conductive material with a resistor may include "resin containing carbon" and the semi-conducting material may include "polyurethane". The resin which is an insulating material may be covered with fluorinated coating (e.g., "Teflon" (Registered Trademark)).

(5) In the above embodiment, the third arm 17 is provided with the electrode pin 22 and the wiring 23 as an example of the discharge current detecting means. An alternative is to omit the electrode pin 22 and provide only the wiring 23. In this case, the third arm 17 itself acts as a means for detecting discharge current between the third arm 17 and the door 3.

(6) The above embodiment is explained about the case of electrostatically painting an object to be painted, i.e., the vehicle body 2 provided with the door 3 as the opening/closing object. Any object to be painted other than a vehicle body may be adopted if only it includes an opening/closing object.

INDUSTRIAL APPLICABILITY

The present invention, as clearly from the above explanation, can provide an electrostatic painting apparatus for electrostatically painting an opening/closing object provided in an object to be painted by a painting means while opening and closing the opening/closing object by an opening/closing means, in which prediction of interference with the opening/closing object is enabled without adding a special explosion-proof structure. The present invention can also provides an electrostatic painting method for electrostatically painting an opening/closing object provided in an object to be painted by a painting means while opening and closing the opening/closing object by an opening/closing means, in which prediction of interference with the opening/closing object is enabled without adding a special explosion-proof structure.

The invention claimed is:

1. An electrostatic painting method for electrostatically painting an opening/closing object provided in an object to be painted by a painting device while opening and closing the opening/closing object by the opening/closing device, comprising;

applying high voltage to the opening/closing device by a high-voltage applying device to create an electrostatic field around the opening/closing device;

detecting an amount of discharge current discharged between the opening/closing device and the opening/closing object by a discharge current detecting device;

performing electrostatic painting while determining a positional relationship between the opening/closing object and the opening/closing device based on the amount of discharge current detected by the discharge current detecting device, comparing (a) the amount of discharge current to a first current amount while the opening/closing device is moving relative to the opening/closing object, or (b) the amount of discharge current to a first current amount or to a range between a second current amount that is smaller than the first current amount and a third current amount that is smaller than the second current amount while the opening/closing device is engaged with the opening/closing object;

wherein the first current amount, second current amount, and third current amount are predetermined threshold values for determining whether the positional relationship is normal or abnormal.

2. The electrostatic painting method according to claim 1, wherein the step of performing electrostatic painting comprises spraying paint particles that have an electrostatic charge of the same polarity as the charge applied to the opening/closing device by the high-voltage applying device.

3. An electrostatic painting apparatus for electrostatically painting an opening/closing object provided in an object to be painted by a painting device while opening and closing the opening/closing object by an opening/closing device, comprising;

a high-voltage applying device for applying high voltage to the opening/closing device to create an electrostatic field around the opening/closing device; and a discharge current detecting device that detects an amount of discharge current flowing between the opening/closing device and the opening/closing object; and, a positional relationship determining device that determines a positional relationship between the opening/closing object and the opening/closing device based on the amount of discharge current, the positional relationship determining device being configured to: (a) compare the amount of discharge current to a first current amount while the opening/closing device is moving relative to the opening/closing object, or (b) compare the amount of discharge current to a first current amount or to a range between a second current amount that is smaller than the first current amount and a third current amount that is smaller than the second current amount while the opening/closing device is engaged with the opening/closing object;

wherein the first current amount, second current amount, and third current amount are predetermined threshold values for determining whether the positional relationship is normal or abnormal.

4. The electrostatic painting apparatus according to claim 1, wherein:

the opening/closing device includes an articulated robot having a plurality of arms connected in series and an engaging tool engageable with the opening/closing object, the tool being placed at a distal end portion of a distal-side arm of the arms, the discharge current detecting device includes an electrode pin placed in the distal-side arm, and the high voltage applying device is electrically coupled to at least the distal-side arm.

5. The electrostatic painting apparatus according to claim 4, wherein the engaging tool is provided with a position sensor that detects the position of the opening/closing object.

6. The electrostatic painting apparatus according to claim 1, further comprising a spray nozzle that sprays paint particles having an electrostatic charge that is the same polarity as the charge applied to the opening/closing device by the high-voltage applying device.

* * * * *